US011359164B2

(12) United States Patent
Jarufe et al.

(10) Patent No.: US 11,359,164 B2
(45) Date of Patent: Jun. 14, 2022

(54) GUTTER CLEANING COMPOSITION COMPRISING A MIXTURE OF THREE NONIONIC SURFACTANTS

(71) Applicant: Rust-Oleum Corporation, Vernon Hills, IL (US)

(72) Inventors: Juan Jarufe, Pleasant Prairie, WI (US); William Dennison, Vernon Hills, IL (US)

( * ) Notice: Subject to any disclaimer, the term of this patent is extended or adjusted under 35 U.S.C. 154(b) by 0 days.

(21) Appl. No.: 15/908,170

(22) Filed: Feb. 28, 2018

(65) Prior Publication Data

US 2018/0251707 A1 Sep. 6, 2018

Related U.S. Application Data

(60) Provisional application No. 62/465,519, filed on Mar. 1, 2017.

(51) Int. Cl.

| | |
|---|---|
| ***C11D 1/825*** | (2006.01) |
| ***C11D 1/75*** | (2006.01) |
| ***C11D 1/722*** | (2006.01) |
| ***C11D 3/20*** | (2006.01) |
| ***E04D 13/064*** | (2006.01) |
| ***C11D 3/10*** | (2006.01) |
| ***C11D 3/08*** | (2006.01) |
| ***C11D 11/00*** | (2006.01) |
| ***C11D 3/18*** | (2006.01) |
| ***C11D 1/835*** | (2006.01) |
| ***C11D 3/37*** | (2006.01) |
| ***C11D 3/33*** | (2006.01) |
| ***E04D 13/076*** | (2006.01) |
| *C11D 1/62* | (2006.01) |
| *C11D 1/00* | (2006.01) |
| *C11D 1/72* | (2006.01) |

(52) U.S. Cl.

CPC ..... *C11D 1/75* (2013.01); *C11D 1/722* (2013.01); *C11D 1/835* (2013.01); *C11D 3/08* (2013.01); *C11D 3/10* (2013.01); *C11D 3/188* (2013.01); *C11D 3/2082* (2013.01); *C11D 3/33* (2013.01); *C11D 3/373* (2013.01); *C11D 11/0023* (2013.01); *C11D 11/0058* (2013.01); *E04D 13/064* (2013.01); *E04D 13/0765* (2013.01); *C11D 1/006* (2013.01); *C11D 1/62* (2013.01); *C11D 1/72* (2013.01)

(58) Field of Classification Search

CPC .. C11D 1/004; C11D 1/75; C11D 1/72; C11D 1/825; C11D 1/62; C11D 1/835; C11D 3/10; C11D 3/188; C11D 3/2037; C11D 3/33; C11D 3/48; C11D 7/14; C11D 9/12; C11D 11/0023

See application file for complete search history.

(56) References Cited

U.S. PATENT DOCUMENTS

| | | | | |
|---|---|---|---|---|
| 4,455,250 | A * | 6/1984 | Frazier | C11D 3/48 510/106 |
| 6,159,916 | A * | 12/2000 | Robbins | C11D 1/662 510/191 |
| 6,184,195 | B1 * | 2/2001 | Cheung | A01N 25/02 510/245 |
| 6,281,178 | B1 * | 8/2001 | Ryklin | C11D 1/24 510/179 |
| 2006/0115440 | A1 * | 6/2006 | Arata | A61Q 5/02 424/65 |
| 2009/0197786 | A1 * | 8/2009 | Perry | C11D 1/835 510/191 |
| 2015/0368593 | A1 * | 12/2015 | Serobian | C11D 3/33 134/26 |
| 2020/0040280 | A1 * | 2/2020 | Medlinski | C11D 3/044 |

* cited by examiner

*Primary Examiner* — Charles I Boyer
(74) *Attorney, Agent, or Firm* — McDonnell Boehnen Hulbert & Berghoff LLP

(57) ABSTRACT

Cleaning compositions including one or more non-ionic surfactants; one or more quaternary ammonium compounds; at least one citrus terpene; one or more chelating agent and water, the cleaning compositions useful for cleaning alkaline surfaces such as building gutters.

33 Claims, No Drawings

GUTTER CLEANING COMPOSITION COMPRISING A MIXTURE OF THREE NONIONIC SURFACTANTS

BACKGROUND OF THE INVENTION

This application claims priority to U.S. provisional patent application No. 62/465519, filed on Mar. 1, 2017, the specification of which is incorporated herein by reference.

(1) Field of the Invention

This invention concerns cleaning compositions and methods for applying the cleaning compositions to a surface such as a gutter to remove dirt and debris from the surface.

(2) Description of the Art

Many cleaning compositions exist that are useful for cleaning easy to reach surfaces. These cleaning solutions typically require the use of some physical device and force—such as a sponge, brush, rag, pressurized stream of water and so forth—to be effective at removing dirt and debris from surfaces.

However, some surfaces, such as gutter surfaces, become dirty but are not amenable to cleaning with compositions that require the use of cleaning devices and physical input because they are not easily accessible. Therefore, there is a need for cleaning solutions that can be applied to hard to reach surfaces such as gutters that are capable of removing dirt and debris from the hard to reach surfaces without physical cleaning assistance.

SUMMARY OF THE INVENTION

This invention includes cleaning compositions and methods for their use that are able to clean dirty surfaces without the use of cleaning devices and physical assistance.

One aspect of this invention are cleaning compositions that comprise:

- From about 1.0 to about 40 wt % of one or more non-ionic surfactants such as nonionic surfactant based on amine oxides; nonionic surfactants based upon alcohol ethoxylates; and nonionic fluorosurfactants. More narrowly the composition may include two or more non-ionic surfactants and preferably three or more nonionic surfactants where the first surfactant is from about 0.01 about 10 wt % and more narrowly from about 0.01 to about 4.00 wt % of one or more nonionic surfactant compounds and more specifically a nonionic surfactant based on an amine oxide such as lauramine oxide (Ammonyx LO); the second surfactant is from about 0.01 to 15 wt % and more narrowly from about 0.01 to about 8.00 wt % of one or more nonionic surfactant compounds and more specifically nonionic surfactants based upon alcohol ethoxylates such as Tergitol 15-S-7 from Dow Chemical; and the third nonionic surfactant is from about 0.01 to about 5 wt % and more narrowly from about 0.01 to about 1.00 wt % of at least one nonionic fluorosurfactant such as Thetawet FS-8150;
- From about 0.01 to about 15 wt % and more narrowly from about 0.01 to about 9.00 wt % of one or more quaternary ammonium compounds such as ethylbis (hydroxyethyl) tallow akyl, ethoxylated sulfates (salts) such as Crodaquat TES;

- From about 0.01 to about 5 wt % and more narrowly from about 0.01 to about 2.00 wt % of at least one citrus terpene such as D'liminene.
- From about 5.00 to about 15.00 wt % of one or more chelating agent such as EDTA or a derivate thereof like tetrasodium EDTA (Dissolvine E-39);
- Optionally from about 0.01 to about 5.0 wt % and more narrowly from about 0.01 to about 2.5 wt % of at least one carbonate and/or bicarbonate compound such as soda ash;
- Optionally from about 0.01 to about 7 wt % and more narrowly from about 0 to about 3.00 wt % of at least one soil anti-redeposit ion agent such at a silicate or silane material like sodium metasilicate (Metso 20); and
- From about 0.01 to about 95 wt % water and more narrowly from about 50 to about 95 wt % water.

The cleaning compositions of this invention preferably contain no anionic type surfactant constituents, and also preferably include no more than about 5 wt % and more preferably no more that about 2 wt % of volatile organic constituents (VOCs). In addition, the compositions of this invention may be suitable for cleaning alkaline hard surfaces and optionally include as an alkalinity constituent, one or more of a carbonate and/or bicarbonate compounds.

The cleaning compositions of this invention may be packaged as a concentrate including no water or less than the optimal amount of water or the compositions may be packaged fully diluted with water and ready to use. The methods of this invention include applying an effective amount of a cleaning composition to a surface in need of cleaning with a low pressure delivery proportioning device; allowing the applied cleaning composition to remain in contact with the surface in need of cleaning for a period of time sufficient to allow the cleaning composition to dislodge dirt and other debris from the surface and removing the cleaning composition including dislodged dirt and debris from the surface.

In one aspect for cleaning a dirty surface with the cleaning composition including the steps of: applying a cleaning composition described herein to a surface of a dirty object; allowing the cleaning composition to remain in contact with the dirty object surface for a period of time sufficient to allow the cleaning composition to dislodge at least a portion of dirt and other debris from the surface to form used cleaning solution including cleaning solution and dislodged dirt and debris; and removing at least a portion of the used cleaning composition from the dirty object surface.

DESCRIPTION OF THE CURRENT EMBODIMENT

The present invention relates to cleaning compositions that are useful for cleaning dirty surfaces and in particular dirty surfaces of residential and commercial gutters. This invention further relates to methods for cleaning gutters and other dirty surfaces with compositions of this invention.

In one aspect, this invention includes high performance, highly aqueous, alkaline hard surface cleaning composition useful in the cleaning of home exterior metal gutter hard surfaces such as hard surfaces including or marred by black streaks, dirt, grime, mold, mildew, algae, tree sap, acid rain and combinations thereof.

Examples of useful compositions are those that comprise at least one secondary alcohol ethoxylate, an ethoxylated quaternary ammonium compound an antistatic agent as the primary surfactant constituents and an amine oxide as a contersurfactant constituent, an alkalinity constituent, preferably an alkalinity constituent selected from, carbonate and/or bicarbonate compounds; a soil anti-redeposition agent; nonionic fluorosurfactant (to enhance wetting of the substrate), a chelating agent and a citrus terpene (to enhance soil removal) the sole organic solvent constituent, and water.

The compositions are storage stable, and are not undesirably irritating to the skin or mucous tissues of the user. The compositions are reported below in percent by weight (based on 100% total weight of a composition including water): The gutter cleaning compositions provide excellent cleaning of the soils on the exterior and interior of home and industrial exterior metal gutter surfaces.

A. The compositions of this invention generally include from about 1.0 to about 40 wt % of one or more non-ionic surfactants such as nonionic surfactant based on amine oxides, nonionic surfactants based upon alcohol ethoxylates and nonionic fluorosurfactants. More narrowly the composition may include two or more nonionic surfactants and preferably three or more nonionic surfactants. The non-ionic surfactants are useful in that they help the composition wet the surface being cleaned and further they break down the interface between water and oils and/or dirt and they hold these oils and dirt in suspension, and so allow their removal.

Where three or more non-ionic surfactants are used, then the first non-ionic surfactant is present in the composition in an amount ranging from about 0.01 about 10 wt % and more narrowly from about 0.01 to about 4.00 wt %. The first non-ionic surfactant is preferably a nonionic surfactant based on an amine oxide such as lauramine oxide (Ammonyx LO).

The second non-ionic surfactant is present in the composition in an amount ranging from about 0.01 to 15 wt % and more narrowly from about 0.01 to about 8.00 wt %. The second non-ionic surfactant is preferably one or more non-ionic surfactants based upon alcohol ethoxylates such as Tergitol 15-S-7 from Dow Chemical, C9-C11 linear alcohol ethyoxlyate (Biosoft N91-6), and alcohol ethyoxylate blends such as Vitech Q3.

The third non-ionic surfactant is present in the composition in an amount ranging from about 0.01 to about 5 wt % and more narrowly from about 0.01 to about 1.00 wt %. The third non-ionic surfactant is preferably at least one nonionic fluorosurfactant such as Thetawet FS-8150—short-chain telomer-based fluorosurfactant that is sparingly water soluble, stable in acids, bases and oxidizing solutions, has a narrow range ethoxylation and is VOC free;

B. The compositions of this invention generally include from about 0.01 to about 9.00 wt % of one or more quaternary ammonium compounds such as ethylbis (hydroxyethyl) tallow akyl, ethoxylated sulfates (salts) such as Crodaquat TES. The quartenary ammonium compounds are good wetting agents and in particular can act as cationic surfactants.

C. The compositions generally include from about 0.01 to about 2.00 wt % of at least one citrus terpene such as D'liminene. Citrus terpenes are naturally occurring compounds that are added to the cleaning compositions for their solvent properties.

D. The compositions generally include from about 5.00 to about 15.00 wt % of one or more chelating agent such as EDTA or a derivate thereof like tetrasodium EDTA (Dissolvine E-39) and sodium gluconate. Chelating agents are added to the compositions because they can form soluble complexes with metal ions and this functionality enables them to remove dirt and scale, soften the water and boost the hygienic cleaning action of cleaning compositions.

E. The compositions optionally include from about 0.01 to about 2.5 wt % of at least one carbonate and/or bicarbonate compound such as soda ash, caustic soda, caustic potash and the like. Carbonates and bicarbonates are added to the composition as alkalinity constituents that facilitate the cleaning of alkaline hard surfaces.

F. The compositions optionally include from about 0 to about 3.00 wt % of at least one soil anti-redeposit ion agent such as propylene glycol, monoethanolamine, and silicate or silane materials like potassium silicate and sodium metasilicate (Metso 20). The purposes of the soil anti-deposit or soil/dirt stabilizer is at least to help keep soil and dirt removed from the surface in solution where it can be flushed away.

G. The compositions—when ready to use—generally include from about 50 to about 95 wt % water. However, the compositions can be prepared as a concentrate to which water can be added at a later time to form a ready to use solution. Water acts as one or more of a diluent and a solvent for the composition ingredients.

H. The cleaning compositions may include from 0.01 to about 5.0 wt % of one or more of the following optional ingredients: (i) hydrophobic glycol ethers as solvents to aid in the removal of hydrophobic stains; (ii) water hardness reducers such as sodium citrate; (iii) amphoteric surfactants such as disodium dodecylimidazolinum dicarboxylate; (iv) foam stabilizers such as glycerin; and (v) terpene solvents.

The cleaning compositions of this invention are formulated by admixing the composition ingredients with water to form a cleaning composition. The cleaning composition may be kept in a container for an extended period of time before use. The cleaning composition is used by optionally agitating composition and then applying the composition, for example with a spray bottle, to the surface is being cleaned. While the composition is especially useful to clean the outside surfaces of household and industrial gutters, the cleaning compositions of this invention may be used to clean any surface that are marred with dirt and other debris described above.

Once the cleaning compositions are applied to a surface to be cleaned, in many cases the compositions will foam on the surface which allows the composition to remain in contact with the surface to be cleaned for an extended period of time. In one aspect of the invention, the cleaning composition is allowed to remain in contact with the surface without the application of an external force such as brush, cloth, sponge etc. . . to promote the separation of dirt and debris from the surface. The composition may remain in contact with the surface being cleaned for a period of time ranging from about 30 seconds to about 10 minutes or more and more preferably from about 2 to about 5 minutes or until the foam subsides. The composition may then be removed by applying water to the cleaning composition containing surface to flush the cleaning composition away from the surface. Physical methods such as brushes and rags may also be used to remove the cleaning compositions and associated removed dirt and debris. These cleaning steps can be repeated until the desired degree of cleaning is achieved.

Several different gutter cleaner formulations were prepared and tested. The formulations were applied to the surface of a dirty residential gutter. The formulation, test method and results are set forth in the tables below.

Experimental Formulations and Test Results

| Raw Material | Wt % |
|---|---|
| FORMULATION NO. 1 | |
| Deionized Water | 80 |
| Sodium Gluconate (chelating agent) | 2.5 |
| Caustic Potash 45% (carbonate/bicarbonate) | 1 |
| PQ Kasil # 6 (potassium silicate solution) | 2.25 |
| Biosoft N91-6 (non-ionic surfactant-$C_9$-$C_{11}$ linear alcohol ethoxylate) | 4 |
| Dowfax 2A1 (anionic surfactant-alkyldiphenyloxide disulfonate) | 3.75 |
| Dowanol PNB (hydrophobic glycol ether) | 2.5 |
| Dissolvine E-39 (tetrasodium EDTA) | 1.5 |
| Sodium Xylene Sulphonate (anionic surfactant) | 2.5 |
| | 100 |
| PH conc; 12.88 Spec. Gravity: 1.0588<br>Performance Testing 6X Dilution, (%) Soil Removal: 50-60<br>Formulation #1: Noted that Formulation provided marginal cleaning but has an acceptable level of foam. Formulation had poor rinsing properties.<br>Detergent Dwell time: 2 min. | |
| FORMULATION NO. 2 | – |
| Deionized water | 78 |
| Sodium Gluconate (chelating agent) | 2.5 |
| Caustic Potash 45% (carbonate/bicarbonate) | 1.25 |
| PQ Kasil # 6 (potassium silicate solution) | 2.5 |
| Biosoft N91-6 (non-ionic surfactant-$C_9$-$C_{11}$ linear alcohol ethoxylate) | 4 |
| Dowfax 2A1 (anionic surfactant-alkyldiphenyloxide disulfonate) | 3.25 |
| Dowanol PNB (hydrophobic glycol ether) | 2.5 |
| Dissolvine E-39 (tetrasodium EDTA) | 1.5 |
| Sodium Xylene Sulphonate (anionic surfactant) | 2.5 |
| | 100 |
| PH conc; 12.80 Spec. Gravity: 1.0648<br>Performance Testing, (%) Soil Removal: 60-70<br>Formulation #2 changes: Increase Base Alkali, Alkali silicates, to improve soil removal/rinsing<br>Formulation #2: Noted slight improvement in Cleaning/rinsing and slightly reduced level of foam.<br>Detergent Dwell time: 2 min. | |
| FORMULATION NO. 3 | |
| Deionized water | 77 |
| Sodium Gluconate (chelating agent) | 2.5 |
| Caustic Potash 45% (carbonate/bicarbonate) | 1.5 |
| PQ Kasil #6 (potassium silicate solution) | 2.75 |
| Biosoft N91-6 (non-ionic surfactant-$C_9$-$C_{11}$ linear alcohol ethoxylate) | 4 |
| Dowfax 2A1 (anionic surfactant-alkyldiphenyloxide disulfonate) | 3.4 |
| Ammonyx LO (lauramine oxide) | 2 |
| Dowanol PNB (hydrophobic glycol ether) | 2.5 |
| Dissolvine E-39 (tetrasodium EDTA) | 1.5 |
| Sodium Xylene Sulphonate (anionic surfactant) | 2.85 |
| | 100 |
| PH conc; 12.80 Spec. Gravity: 1.0648<br>Performance Testing 6X dilution, (%) Soil Removal: 60-70<br>Formulation #3 changes: Increase base alkali, alkali silicates, a Increase Dowfax 2A1 detergent, include higher foaming detergent. Ammonyx LO to increase foam and detergency.<br>Formulation #3: Noted no improvement in Cleaning/rinsing. Improved level of foam.<br>Detergent Dwell time; 2 Min | |
| FORMULATION NO. 4 | |
| Deionized water | 73 |
| Sodium Citrate (water hardness reducer) | 2.75 |
| Caustic Potash 45% (carbonate/bicarbonate) | 1.25 |
| PQ Kasil #6 (potassium silicate solution) | 3 |
| Biosoft N91-6 (non-ionic surfactant-$C_9$-$C_{11}$ linear alcohol ethoxylate) | 6 |
| Dowfax 2A1 (anionic surfactant-alkyldiphenyloxide disulfonate) | 3.75 |
| Mirapon FBS (surfactant-disodium dodecylimidazolinum dicarboxylate) | 1.75 |
| Dowanol PNB (hydrophobic glycol ether) | 2.75 |

-continued

| Raw Material | Wt % |
|---|---|
| Dissolvine E-39 (tetrasodium EDTA) | 1.5 |
| Sodium Xylene Sulphonate (anionic surfactant) | 2 |
| Propylene Glycol (dirt stabilizer) | 2.25 |
| | 100 |

PH conc; 12.80 Spec. Gravity: 1.0618
Performance Testing 6X dilution, (%) Soil Removal: 60-70
Formulation #4 changes: Increase Alkali silicates; replace sodium gluconate with sodium citrate; Increase Dowfax 2A1Detergent Biosoft N91-6 nonionic detergent;
replace Ammonyx LO with Mirapon FBS Detergent to improve detergency Formulation #4: No improvement in Cleaning/rinsing.
Improved level of foam.
Detergent Dwell time: 2 min

FORMULATION NO. 5

| | |
|---|---|
| Deionized water | 73.51 |
| Sodium Citrate (water hardness reducer) | 2.73 |
| Metso 20 (sodium metasilicate) | 2.73 |
| Caustic Potash 45% (carbonate/bicarbonate) | 2.08 |
| Biosoft N91-6 (non-ionic surfactant-$C_9$-$C_{11}$ linear alcohol ethoxylate) | 2.73 |
| Ammonyx LO (lauramine oxide) | 1.36 |
| Cedephos FA-600 (alkyl ether phosphate-anionic surfactant) | 1.82 |
| Calfoam ES 603 (sodium lauryl ether sulfate-ether sulfate-anionic surfactant) | 3.47 |
| Dissolvine E-39 (tetrasodium EDTA) | 1.3 |
| Monoethanolamine (dirt stabilizer) | 2.78 |
| Sodium Xylene Sulphonate (anionic surfactant) | 0.95 |
| Dowanol PNB (hydrophobic glycol ether) | 4.54 |
| | 100 |

PH conc; 12.80 Spec. Gravity: 1.0598
Performance Testing 6x dilution, (%) Soil Removal: 60-70
Formulation #5 changes: change alkali silicates to Metso 20;
Increase Dowfax 2A1 Detergent; replace Mirapon FBS
Increase base Alkali, Cedephos FA-600, and Increase Dowanol PNB.
Add Calfoam ES603 detergent to enhance cleaning and Monoethanol; add amine to improve soil penetration.
Formulation #5: Noted no improvement in cleaning but improved level of foam and slightly better rinsing of soil from surface.
Detergent Dwell time: 2 min

FORMULATION NO. 6

| | |
|---|---|
| Deionized water | 70.3 |
| Sodium Citrate (water hardness reducer) | 3 |
| PQ Kasil # 6 (potassium silicate solution) | 3.26 |
| Caustic Potash 45% (carbonate/bicarbonate) | 2.5 |
| Biosoft N91-6 (non-ionic surfactant-$C_9$-$C_{11}$ linear alcohol ethoxylate) | 3 |
| Ammonyx LO (lauramine oxide) | 1.5 |
| Cedephos FA-600 (alkyl ether phosphate-anionic surfactant) | 2.5 |
| Calfoam ES 603 (sodium lauryl ether sulfate-ether sulfate-anionic surfactant) | 3.7 |
| Dissolvine E-39 (tetrasodium EDTA) | 1.5 |
| Monoethanolamine (dirt stabilizer) | 3 |
| Sodium Xylene Sulphonate (anionic surfactant) | 1.25 |
| Dowanol PNB (hydrophobic glycol ether) | 4.5 |
| | 100 |

PH conc; 12.81 Spec. Gravity: 1.0677
Performance Testing 6X dilution, (%) Soil Removal: 60-70
Formulation #6 changes: change Alkali silicates to Kasil #6 (Potassium Silicate);
Increase all Detergents and alkali.
Formulation #6: Noted no improvement in cleaning.
Improved level of foam and slightly better rinsing of soil
Detergent Dwell time: 2 min

FORMULATION NO. 7

| | |
|---|---|
| Deionized water | 70.5 |
| Sodium Citrate (water hardness reducer) | 3 |
| Metso 20 (sodium metasilicate) | 3.75 |
| Caustic Potash 45% (carbonate/bicarbonate) | 3.5 |
| Biosoft N91-6 (non-ionic surfactant-$C_9$-$C_{11}$ linear alcohol ethoxylate) | 3 |
| Ammonyx LO (lauramine oxide) | 1.5 |
| Cedephos FA-600 (alkyl ether phosphate-anionic surfactant) | 3 |
| Calfoam ES 603 (sodium lauryl ether sulfate-ether sulfate-anionic surfactant) | 3.75 |

-continued

| Raw Material | Wt % |
|---|---|
| Dissolvine E-39 (tetrasodium EDTA) | 1.5 |
| Monoethanolamine (dirt stabilizer) | 3 |
| Sodium Xylene Sulphonate (anionic surfactant) | 1 |
| Dowanol PNB (hydrophobic glycol ether) | 2.5 |
| | 100 |

PH conc; 12.51 Spec. Gravity: 1.0837
Performance Testing, (%) Soil Removal: 60-70
Formulation #7 changes: Change Alkali silicates to Metso 20, at higher percentage; Decrease Dowanol PNB; Increase level of caustic potash 45% and Cedephos FA600 Detergent.
Formulation #7: Noted no improvement in Cleaning.
Improved level of foam but no improvement in soil rinsing.
Detergent Dwell time: 2 min

FORMULATION NO. 8

| | |
|---|---|
| Deionized water | 74 |
| Biosoft S-101 (anionic surfactant-linear alkylbenzene sulfonic acid) | 3.19 |
| Metso 20 (sodium metasilicate) | 1.06 |
| Caustic soda 50% (carbonate/bicarbonate) | 1.95 |
| Biosoft N91-6 (non-ionic surfactant-$C_9$-$C_{11}$ linear alcohol ethoxylate) | 2.5 |
| Ammonyx LO (lauramine oxide) | 1.5 |
| Monoethanolamine (dirt stabilizer) | 3 |
| Calfoam ES-603 (sodium lauryl ether sulfate-ether sulfate-anionic surfactant) | 2.25 |
| Dissolvine E-39 (tetrasodium EDTA) | 1.5 |
| Sodium Xylene Sulphonate (anionic surfactant) | 1.5 |
| Butyl Carbitol (hydrophilic glycol ether-diethylene glycol monobutyl ether-hydrophobicity enhancer) | 3 |
| Stepan Citrimet (low VOC citrus terpene solution) | 1.55 |
| | 100 |

PH conc; 12.83 Spec. Gravity: 1.0662
Performance Testing 6X Dilution, (%) Soil Removal: 60-70
Formulation #8 changes: reduce Metso 20; replace caustic potash with caustic soda 50% at higher percentage.
Replace PNB with Dow Butyl Carbitol; Replace Cedephos FA600 anionic detergent with Biosoft S101 anionic detergent; Eliminate citrate detergent builder.
Incorporate Stepan Citrimet terpene surfactant blend to improve soil removal.
Formulation #8: No improvement in cleaning/rinsing.
Slight residue formation noted after rinsing.
Detergent Dwell time: 2 minutes

FORMULATION NO. 9

| | |
|---|---|
| Deionized water | 73 |
| Biosoft S-101 (anionic surfactant-linear alkylbenzene sulfonic acid) | 3.23 |
| Metso 20 (sodium metasilicate) | 1.06 |
| Caustic soda 50% (carbonate/bicarbonate) | 1.86 |
| Biosoft N91-6 (non-ionic surfactant-$C_9$-$C_{11}$ linear alcohol ethoxylate) | 2.75 |
| Ammonyx LO (lauramine oxide) | 2 |
| Monoethanolamine (dirt stabilizer) | 3 |
| Calfoam ES-603 (sodium lauryl ether sulfate-ether sulfate-anionic surfactant) | 2.5 |
| Dissolvine E-39 (tetrasodium EDTA) | 2.75 |
| Sodium Xylene Sulphonate (anionic surfactant) | 0.6 |
| Butyl Carbitol (hydrophilic glycol ether-diethylene glycol monobutyl ether-hydrophobicity enhancer) | 2.25 |
| D'Limonene (citrus terpene) | 2 |
| | 100 |

PH conc; 12.88 Spec. Gravity: 1.0588
Performance Testing, (%) Soil Removal: 60-70
Formulation #9 Changes: Replace Stepan citrimet with Straight D'limonene; Reduce carbitol; Increase all base detergents.
Increase Dissolvine E-39 Chelate.
Formulation #9: No improvement in cleaning, rinsing.
Slight residue formation after rinsing noted.
Detergent Dwell time: 2 min

FORMULATION NO. 10

| | |
|---|---|
| Deionized water | 73.35 |
| Deforest DLN 2314 (D'limonene emulsifier) | 5.1 |
| D'limonene (citrus terpene) | 3 |
| Caustic Potash 45% (carbonate/bicarbonate) | 0.75 |
| Biosoft N91-6 (non-ionic surfactant-$C_9$-$C_{11}$ linear alcohol ethoxylate) | 2.75 |

-continued

| Raw Material | Wt % |
|---|---|
| Metso 20 (sodium metasilicate) | 1 |
| Mirapon FBS (surfactant-disodium dodecylimidazolinum dicarboxylate) | 4 |
| Dissolvine E-39 (tetrasodium EDTA) | 3 |
| Monoethanolamine (dirt stabilizer) | 2 |
| Sodium Xylene Sulphonate (anionic surfactant) | 0.6 |
| Butyl Carbitol (hydrophilic glycol ether-diethylene glycol monobutyl ether-hydrophobicity enhancer) | 4.45 |
| | 100 |

PH conc; 12.88 Spec. Gravity: 1.0588
Performance Testing 6x dilution, (%) Soil Removal: 65-75
Formulation #10 changes: Eliminate detergents calfoam ES 603, Ammonyx Lo; Add Detergents Deforest DLN 2314 (d'limonene emulsifier/detergent); Mirapon FBS; increase Dissolvine E-39 Chelate, D'limonene and butyl carbitol.
Formulation #10: Noted slightly improved cleaning;
Significantly reduced level of foam; no improvement in rinsing.
Detergent Dwell time: 2 min

FORMULATION NO. 11

| | |
|---|---|
| Deionized water | 74.8 |
| Biosoft S-101 (anionic surfactant-linear alkylbenzene sulfonic acid) | 3.23 |
| D'limonene (citrus terpene) | 1.5 |
| Caustic Soda 50% (carbonate/bicarbonate) | 1.86 |
| Vitech Q3 (non-ionic surfactant blend-alcohol ethoxylates) | 2.75 |
| PQ Silicate 2048 (sodium metasilicate) | 1 |
| Calamide C (foam stabilizer-includes glycerin) | 1.6 |
| APFS-14 (flurosurfactant-perfluoroalkyl betaine surfactant) | 0.05 |
| Dissolvine E-39 (tetrasodium EDTA) | 2.75 |
| Monoethanolamine (dirt stabilizer) | 3 |
| Sodium Xylene Sulphonate (anionic surfactant) | 1.96 |
| Butyl Carbitol (hydrophilic glycol ether-diethylene glycol monobutyl ether-hydrophobicity enhancer) | 3 |
| Calfoam ES 603 (sodium lauryl ether sulfate-ether sulfate-anionic surfactant) | 2.5 |
| | 100 |

PH conc; 12.68 Spec. Gravity: 1.0630
Performance Testing 6x dilution, (%) Soil Removal: 60-70
Formulation #11 changes: Modify detergent base; Add calfoam ES 603, Biosoft S101, Stepan Calamide C, to increase foam.
Incorporate Vitech Int Q3 detergent Blend; Advanced Polymer APFS-14 flurosurfactant to improve wetting/soil removal.
increase Dissolvine E-39 Chelate D'limonene and butyl carbitol; Add anhydrous grade of Metso 20,
PQ Silicate 2048. Increase detergent dwell time to 5 min to improve cleaning.
Formulation #11: No Improvement in Cleaning.
Increased level of foam and no improvement in rinsing.
Detergent Dwell time: 5 min

FORMULATION NO. 12

| | |
|---|---|
| Deionized water | 74.8 |
| Biosoft S-101 (anionic surfactant-linear alkylbenzene sulfonic acid) | 3.23 |
| D'limonene (citrus terpene) | 1.5 |
| Caustic Soda 50% (carbonate/bicarbonate) | 1.86 |
| Biosoft N-91-6 (non-ionic surfactant-$C_9$-$C_{11}$ linear alcohol ethoxylate) | 2.75 |
| PQ Silicate 2048 (sodium metasilicate) | 1 |
| Calamide C (foam stabilizer-includes glycerin) | 1.6 |
| APFS-14 Flurosurfactant-(flurosurfactant-perfluoroalkyl betaine surfactant) | 0.05 |
| Dissolvine E-39 (tetrasodium EDTA) | 2.75 |
| Monoethanolamine (dirt stabilizer) | 3 |
| Sodium Xylene Sulphonate (anionic surfactant) | 1.96 |
| Butyl Carbitol (hydrophilic glycol ether-diethylene glycol monobutyl ether-hydrophobicity enhancer) | 3 |
| Calfoam ES 603 (sodium lauryl ether sulfate-ether sulfate-anionic surfactant) | 2.5 |
| | 100 |

PH conc; 12.78 Spec. Gravity: 1.0678
Performance Testing, (%) Soil Removal: 60-70
Formulation #12 changes: Modify formulation F-11 detergent base.
Replace Vitech Int Q3 detergent Blend with Stepan Biosoft N91-6 detergent.
Add Stepan Biosoft S-101 anionic detergent.

FORMULATION NO. 13

| | |
|---|---|
| Deionized water | 74.8 |
| Biosoft S-101 (anionic surfactant-linear alkylbenzene sulfonic acid) | 3.23 |
| D'limonene (citrus terpene) | 1.5 |
| Caustic Soda 50% (carbonate/bicarbonate) | 1.86 |
| Vitech Q3 (non-ionic surfactant blend-alcohol ethoxylates) | 3.75 |

-continued

| Raw Material | Wt % |
|---|---|
| PQ Silicate 2048 (sodium metasilicate) | 1 |
| Calamide C (foam stabilizer-includes glycerin) | 1.6 |
| FS-8150 "ICT nonionic Flurosurfactant" | 0.05 |
| Dissolvine E-39 (tetrasodium EDTA) | 2.75 |
| Monoethanolamine (dirt stabilizer) | 2 |
| Sodium Xylene Sulphonate (anionic surfactant) | 1.96 |
| Butyl Carbitol (hydrophilic glycol ether-diethylene glycol monobutyl ether-hydrophobicity enhancer) | 3 |
| Calfoam ES 603 (sodium lauryl ether sulfate-ether sulfate-anionic surfactant) | 2.5 |
| | 100 |

PH conc; 12.69 Spec. Gravity: 1.0660
Performance Testing, (%) Soil Removal: 60-70
Formulation #13 changes: Modify formulation F-12 detergent base; Reintroduce Vitech Q3 at a higher level; Replace APFS-14 flurosurfactant with ICT FS-8150 Flurosurfactant to improve wetting.
Detergent Dwell time: 5 min

FORMULATION NO. 14

| | |
|---|---|
| Deionized water | 73 |
| Mirapon FBS (surfactant-disodium dodecylimidazolinum dicarboxylate) | 5 |
| D'limonene (citrus terpene) | 2 |
| Caustic potash 45% (carbonate/bicarbonate) | 0.75 |
| Biosoft N-91-6 (non-ionic surfactant-$C_9$-$C_{11}$ linear alcohol ethoxylate) | 2.75 |
| Metso 20 (sodium metasilicate) | 1 |
| FS-8150 "ICT nonionic Flurosurfactant" | 0.1 |
| Dissolvine E-39 (tetrasodium EDTA) | 3 |
| Monoethanolamine (dirt stabilizer) | 2 |
| Butyl Carbitol (hydrophilic glycol ether-diethylene glycol monobutyl ether-hydrophobicity enhancer) | 8 |
| Calfoam ES 603 (sodium lauryl ether sulfate-ether sulfate-anionic surfactant) | 2.4 |
| | 100 |

PH conc; 12.65 Spec. Gravity: 1.0669
Performance Testing, (%) Soil Removal: 70-80
Formulation #14 changes:. Replace Vitech Q3 with Stepan Biosoft N91-6, Increase Dow Butyl Carbitol.
Introduce higher level of D'limonene to improve soil removal, wetting. Replace Biosoft S-101 with Mirapon FBS high foaming detergent.
Formulation #14: Noted improvement in cleaning.
Introduce ICT Fluorosurfactant

FORMULATION NO. 15

| | |
|---|---|
| Deionized water | 65.4 |
| Dissolvine E-39 (tetrasodium EDTA) | 12 |
| Florasolve LX311 (terpene solvent) | 0.5 |
| Soda Ash (light density)(carbonate/bicarbonate) | 2 |
| Videt EqI (surfactant) | 10 |
| Videt QHD (surfactant) | 8 |
| Videt BW (non-VOC solvent-aqueous anionic polymer) | 0.1 |
| Videt JK-50 (non-VOC surfactant) | 2 |
| | 100 |

PH conc; 12.85 Spec. Gravity: 1.0779
Performance Testing 6x, (%) Soil Removal: 70-80
Formulation F-15: This formulation utilizes the following raw materials from Vitech Int. and Florachem.
1) Videt EQI; Nonionic detergent blend.
2) Videt QHD; Nonionic detergent blend.
3) Videt BW, JK-50: Non Voc solvents
4) Florasolve LX 311: Terpene solvent
4) Florasolve LX 311: Terpene replacement solvent
Florachem, Jacksonville FL
Formulation #15:
Reduced level of foam and no improvement in cleaning was noted.

FORMULATION NO. 16

| | |
|---|---|
| Deionized water | 73.9 |
| Metso 20 (sodium metasilicate) | 2 |
| Soda Ash (light density) (carbonate/bicarbonate) | 1.5 |
| Dissolvine E-39 (tetrasodium EDTA) | 12 |
| Crodaquat TES (water-soluble, ethoxylated quaternary compound) | 4.25 |
| D'limonene (citrus terpene) | 0.5 |

-continued

| Raw Material | Wt % |
|---|---|
| Biosoft N91-6 (non-ionic surfactant-$C_9$-$C_{11}$ linear alcohol ethoxylate) | 4 |
| Ammonyx LO (lauramine oxide) | 1.8 |
| Thetawet FS-8150 (non-ionic fluorosurfactant) | 0.05 |
| | 100 |
| PH conc; 12.73 Spec. Gravity: 1.0639<br>Performance Testing 6X, (%) Soil Removal: 80-90<br>Formulation #F-16 changes: Replace Vitech detergent base with Stepan Biosoft N91-6, Ammonyx Lo and Crodaquat TES. Incorporate ICT flurosurfactant Thetewet FS-8150 to improve wetting. Add straight D'limonene for soil removal. Increase Dissolvine E-39 chelate to 12% to enhance soil removal. Add low level of soda ash as base alkali.<br>Formulation #F-16: Notable Improvement in cleaning and improved rinsing of emulsified soil. Gutter surface has a brighter appearance. The Dow high performance non-ionic detergent Tergitol 15-S-7 will be added in place off the Biosoft to improve cleaning further. | |
| FORMULATION NO. 17 | |
| Deionized water | 73.9 |
| Metso 20 (sodium metasilicate) | 2 |
| Soda Ash (light density) | 1.5 |
| Dissolvine E-39 (tetrasodium EDTA) | 12 |
| Crodaquat TES (water-soluble, ethoxylated quaternary compound) | 4.25 |
| D'limonene (citrus terpene) | 0.5 |
| Dow Tergitol 15-S-7 (secondary alcohol ethoxylate-non-ionic surfactant) | 4 |
| Ammonyx LO (lauramine oxide-non-ionic surfactant) | 1.8 |
| Thetawet FS-8150 (non-ionic fluorosurfactant) | 0.05 |
| | 100 |
| PH conc; 12.71 Spec. Gravity: 1.0637<br>Performance Testing 6x, (%) Soil Removal: 90-100<br>Detergent Dwell time: 5 min<br>Formulation #F-17 Changes: Replace Biosoft N91-6 with Dow Tergitol 15-S-7 high performance non-ionic detergent.<br>Formulation #F-16: Notable Improvement in cleaning and excellent rinsing of emulsified soil. Gutter surface has a brighter appearance. The Dow high performance non-ionic detergent Tergitol 15-S-7 has improved cleaning further.<br>Appearance: Clear thin Liquid | |

Dowanol PNB-hydrophobic glycol ether-solvates and couples hydrophobic greases and oils
Metso 20 = -sodium metasilicate
Dissolvine E-39 = Chelating agent-tetrasodium EDTA
Crodaquat TES = cationic surfactant-polyoxyethyene tallow ethosulfate
D'limonene = natural terpene, citrus oil
Tergitol 15-S-7 = nonionic surfactant-secondary alcohol ethoxylate-polyglycol ether
Ammonyx LO = lauramine oxide-foam enhancer/wetting agent-non-ionic surfactant
Thetawet FS-8150 = non-ionic fluorosurfactant-short chain fluorosurfactant From the examples above, Formulation No. 17 exhibited the best overall cleaning perforance. In addition the formulation tests indicated that anionic surfactants were only marginally useful so compositions without an anionic surfactant are preferred.

As noted above, the hard surface-cleaner composition provided according to the invention can be desirably provided as a ready to use concentrate product in a manually operated spray dispensing container. Such a typical container is generally made of synthetic polymer plastic material such as polyethylene, polypropylene, polyvinyl chloride or the like and includes spray nozzle, a dip tube and associated pump dispensing parts and is thus ideally suited for use in a consumer spray-and-rinse application. In such an application, the consumer generally applies an effective amount of the cleaning composition using the proportioning device and within about five minutes thereafter, rinses the treated area with water. In certain applications, however, especially where undesirable stain deposits are heavy, the cleaning composition according to the invention may be left on the stained area until it has effectively loosened the stain deposits after which it may then be wiped off, rinsed off, or otherwise removed. For particularly heavy deposits of such undesired stains, multiple applications may also be used.

What is claimed is:

1. A cleaning composition comprising:

A. from about 1.0 to about 40 wt % of three or more non-ionic surfactants;

B. from about 0.01 to about 15 wt % of one or more quaternary ammonium compounds;

C. from about 0.01 to about 5 wt % of one or more citrus terpenes;

D. from about 5.00 to about 15.00 wt % of one or more chelating agents;

E. from about 0.01 to about 5.00 wt % of one or more carbonate and/or bicarbonate compounds;

F. from about 0.01 to about 7.00 wt % of at least one soil anti-redeposition agent; and G. from 0.01 to about 95 wt % water.

2. The cleaning composition of claim 1 wherein the one or more non-ionic surfactants are selected from one or more the group consisting of nonionic surfactant based on amine oxides;

nonionic surfactants based upon alcohol ethoxylates; and nonionic fluorosurfactants.

3. The cleaning composition of claim 1, wherein the composition includes three or more non-ionic surfactants, wherein the first non-ionic surfactant is present in the composition in an amount ranging from about 0.01 about 10 wt %, the second non-ionic surfactant is present in the composition in an amount ranging from about 0.01 to 15 wt %, and the third non-ionic surfactant is present in the composition in an amount ranging from about 0.01 to about 5 wt %.

4. The cleaning composition of claim 3 wherein the first non-ionic surfactant is present in the composition in an amount ranging from about 0.01 to about 4.00 wt %.

5. The cleaning composition of claim 3 wherein the first non-ionic surfactant is lauramine oxide.

6. The cleaning composition of claim 3 wherein the second non-ionic surfactant is present in an amount ranging from about 0.01 to about 8.00 wt %.

7. The cleaning composition of claim 3 wherein the second non-ionic surfactant is a secondary alcohol ethoxylate.

8. The cleaning composition of claim 3 wherein the third non-ionic surfactant is present in the composition in an amount ranging from about 0.01 to about 1.00 wt %.

9. The cleaning composition of claim 3 wherein the third non-ionic surfactant is a non-ionic fluorosurfactant.

10. The cleaning composition of claim 1 wherein the one or more quaternary ammonium compounds are present in the composition in an amount ranging from about 0.01 to about 9.00 wt %.

11. The cleaning composition of claim 1 wherein the quaternary ammonium compound is a cationic surfactant.

12. The cleaning composition of claim 1 wherein the quaternary ammonium compound is one or more of ethylbis (hydroxyethyl) tallow alkyl, ethoxylated sulfate.

13. The cleaning composition of claim 1 wherein the citrus terpene is present in the composition in an amount ranging from about 0.01 to about 2.00 wt %.

14. The cleaning composition of claim 13 wherein the citrus terpene is D-Limonene.

15. The cleaning composition of claim 1 wherein the chelating agent is one or more of EDTA and derivatives thereof.

16. The cleaning composition of claim 15 wherein the chelating agent is tetrasodium EDTA salt.

17. The cleaning composition of claim 1 wherein the at least one carbonate and/or bicarbonate compound is present in the composition is an amount ranging from 0.01 to about 2.5 wt %.

18. The cleaning composition of claim 1 wherein the at least one carbonate and/or bicarbonate compound is soda ash.

19. The cleaning composition of claim 1 wherein the at least one soil anti-redeposit ion agent is present in the composition in an amount ranging from about 0 to about 3.00 wt %.

20. The cleaning composition of claim 1 wherein the at least one soil anti-redeposition agent is selected from silicates and silanes.

21. The cleaning composition of claim 20 wherein the at least one soil anti-redeposition agent is sodium metasilicate.

22. The cleaning composition of claim 1 wherein water is present is the composition in an amount ranging from about 50 to about 95 wt %.

23. The cleaning composition of claim 1 including no more than about 5 wt % volatile organic constituents.

24. The cleaning composition of claim 1 wherein the composition does not contain anionic surfactants.

25. A cleaning composition comprising:

from about 0.01 about 10 wt % of a first non-ionic surfactant;

from about 0.01 to about 15 wt % of a second non-ionic surfactant;

from about 0.01 to about 5.0 wt % of a third non-ionic surfactant;

from about 0.01 to about 15 wt % of one or more quaternary ammonium compounds;

from about 0.01 to about 5 wt % of at least one citrus terpene;

from about 5.00 to about 15.00 wt % of one or more chelating agent;

from about 0.01 to about 5.00 wt % of at least one carbonate and/or bicarbonate compound;

from about 0.01 to about 7.00 wt % a silicate or silane material; and from about 0.01 to about 95 wt % water.

26. A method for cleaning a dirty surface with the cleaning composition comprising the steps of:

applying the cleaning composition of claim 1 to a surface of a dirty object;

allowing the cleaning composition to remain in contact with the dirty object surface for a period of time sufficient to allow the cleaning composition to dislodge at least a portion of dirt and other debris from the surface to form used cleaning solution including cleaning solution and dislodged dirt and debris; and removing at least a portion of the used cleaning composition from the dirty object surface.

27. The method of claim 26 wherein the cleaning composition is removed by flushing the object surface with water.

28. The method of claim 26 wherein the dirty object is a building gutter.

29. The method of claim 27 wherein the at least a portion of the cleaning composition is flushed from the dirty object without physical cleaning assistance.

30. The cleaning composition of claim 1 comprising three or more non-ionic surfactants, wherein a first non-ionic surfactant is present from about 0.01 about 10 wt %, a second non-ionic surfactant is present from about 0.01 to about 15 wt %, and a third non-ionic surfactant is present from about 0.01 to about 5.0 wt %;

from about 0.01 to about 9.00 wt % of one or more quaternary ammonium compounds selected from one or more of ethylbis(hydroxyethyl) tallow alkyl, ethoxylated sulfate;

from about 0.01 to about 5.00 wt % of at least one carbonate and/or bicarbonate compound; and from about 0.01 to about 7.00 wt % of at least one soil anti-redeposition agent that is a silicate or silane material.

31. The cleaning composition of claim 3, wherein the first non-ionic surfactant is lauramine oxide present in an amount ranging from about 0.01 to about 4.00 wt %;

the second non-ionic surfactant is a secondary alcohol ethoxylate present in an amount ranging from about 0.01 to about 8.00 wt %; and the third non-ionic surfactant is a non-ionic fluorosurfactant present in an amount ranging from about 0.01 to about 1.00 wt %.

32. The cleaning composition of claim 31, wherein from about 0.01 to about 9.00 wt % of one or more quaternary ammonium compounds;

the citrus terpene is D-Limonene present in an amount ranging from about 0.01 to about 2.00 wt %;

the at least one carbonate and/or bicarbonate compound is soda ash present in an amount ranging from 0.01 to about 2.5 wt %;

the at least one soil anti-redeposit ion agent is selected from silicates and silanes, present in an amount ranging from about 0 to about 3.00 wt %; and from about 50 to about 95 wt % water.

33. The cleaning composition of claim 31, wherein the composition does not contain anionic surfactants.

* * * * *